US005111543A

United States Patent [19]

Epshetsky et al.

[11] Patent Number: 5,111,543

[45] Date of Patent: May 12, 1992

[54] BED WITH FOLDABLE EARTHQUAKE PROTECTIVE COVER

[75] Inventors: Yefim Epshetsky, San Francisco; Garry Belenky, Daly City; Boris Khlevner, San Francisco, all of Calif.

[73] Assignee: Alexander Shkolnik, San Mateo, Calif. ; a part interest

[21] Appl. No.: 687,104

[22] Filed: Apr. 18, 1991

[51] Int. Cl.[5] ..... A47C 29/00

[52] U.S. Cl. ..... 5/424; 5/414; 5/1; 52/167 R

[58] Field of Search ..... 5/1, 414, 415, 424, 5/425, 427, 430, 9.1, 508; 52/167, 98

[56] References Cited

U.S. PATENT DOCUMENTS

| | | | |
|---|---|---|---|
| 2,607,047 | 8/1952 | Posey | 5/1 |
| 2,738,523 | 3/1956 | Bryant | 5/425 |
| 2,844,828 | 7/1958 | Stark | 5/425 |
| 4,069,527 | 1/1978 | Harris | 5/414 |
| 4,490,864 | 1/1985 | Wicker, Jr. | 5/9.1 |
| 4,550,457 | 11/1985 | Dukkers | 5/414 |
| 4,782,541 | 11/1988 | Tuckman | 5/414 |
| 4,965,895 | 10/1990 | Shustov | 5/414 |

*Primary Examiner*—Eric K. Nicholson

[57] ABSTRACT

A foldable earthquake protective bed comprises a support frame (10) and two moveable members (20 and 22) pivotally attached to the support frame (10) and capable of being pivoted between a folded position in which the moveable members are arranged as conventional parts of the bed and an unfolded position in which they form a rigid protective cover above the bed's occupant(s). The bed may have a power drive in the form of a pneumatic cylinder (42) with a piston (43) sliding inside the cylinder (42). A piston rod (44) of the piston (43) is pivotally attached by a link (46) to a bracket (30) of the pivotable member (20) and by a link (48) to a bracket (32) of the pivotable member (22). Compressed air can be admitted to the cylinder (42) from a pressure vessel (50) via a control valve (52). This valve can be activated either manually by pushing a pushbutton (62) built into the bed frame, or automatically from a seismic sensor (58) attached to the wall of the building. When the valve is opened, air is admitted to the cylinder and causes rotation of the pivotable members (20) and (22) into their earthquake protective position. Several other embodiments are shown, including manually driven mechanisms and a mechanism for unfolding the bed under the weight of the bed's occupant.

23 Claims, 5 Drawing Sheets

BED WITH FOLDABLE EARTHQUAKE PROTECTIVE COVER

BACKGROUND

1. Field of the Invention

The present invention relates to earthquake protective structures, particularly to an earthquake protective bed which protects one or more occupants from injuries which may be caused during an earthquake by falling debris or structural elements.

2. Description of Prior Art

Numerous catastrophes due to natural causes, such as earthquakes and tornadoes, or due to those caused by humans, such as explosions, and the like, can all damage dwellings. Such catastrophes may expose an occupant of a dwelling to falling debris when ceilings and upper floors fully or partially collapse. The possibility of danger, or even death, to occupants of such dwellings is very real, particularly when the catastrophe occurs during the night while occupants are asleep and there is no advance warning to permit evacuation of the dwelling. In certain regions of the world where earthquakes and tornadoes are more common, numerous injuries and deaths can do occur when residents are asleep. While housing structures in such regions are generally specially designed and reinforced to be more resistant to damage and collapse, substantial damage can nevertheless occur, particularly when the catastrophes are intense.

In hospitals, houses for elderly people, and nurseries for children, many people remain in bed, not only in the nighttime but also in the daytime, without an ability to leave their beds when an earthquake occurs.

Meanwhile, statistics show that the probability of injuries is greatly reduced when occupants of a building have time to move to shelter under beams, tables, furniture, or other rigid elements of the building.

It has been proposed to protect sleeping occupants from unexpected earthquakes by providing a bed with a protective canopy (U.S. Pat. No. 4,782,541 to Tuchman, November, 1988). This bed has a permanent overhead canopy which is made of a steel mesh which is resistant to falling debris. The canopy covers the lower section of the bed and is supported by spring-loaded telescopic tubes. Normally the tubes maintain the canopy in the upper or raised position and allow the canopy to lower with attendant compression of the springs to convert or absorb the energy of the falling debris.

Because the canopy is installed permanently, a bed of such construction has an unattractive appearance, and occupies extra space in the vertical direction. This creates the impression that the room is smaller than its actual dimensions. Also the canopy is not rigid enough to withstand impacts from falling structural elements of the building. Besides, the metal mesh collects dust which cannot be easily removed. When the mesh is cleaned, the dust particles fall down through the mesh cells onto the bed bed. Further, the canopy increases the weight of the bed. This canopied bed also is inconvenient to move and cannot be easily adapted to match the interior of the room.

OBJECTS AND ADVANTAGES OF THE INVENTION

It is an object of the invention to solve the above problems by providing an earthquake protective bed which has a rigid protective cover and earthquake-protective elements formed of structural elements of a conventional bed. Still another object is to provide a collapsible earthquake-protective bed which can be converted into an earthquake-protective position, either at the will of the bed occupant, or automatically once the earthquake starts. Further objects are to provide a bed of the above-mentioned type which is attractive in appearance, occupies the same space as a conventional bed, is easy to clean, and is easy to move. Other advantages and objects of the invention will become apparent from a consideration of the ensuing description and drawings.

REFERENCE NUMERALS USED IN THE SPECIFICATION AND DRAWINGS

Figure 1:
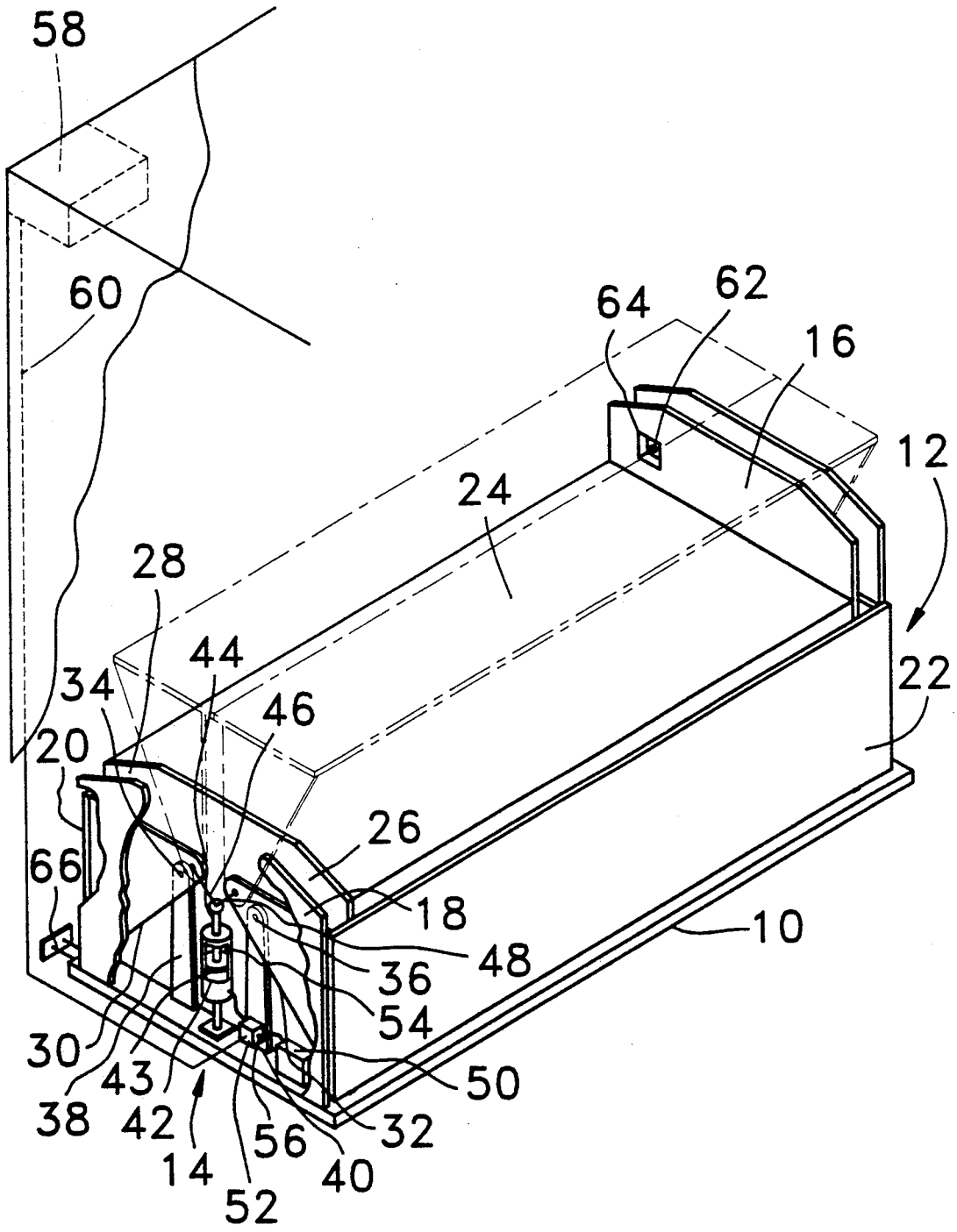
FIG. 1 is a perspective view of an earthquake protective bed of the present invention with mechanically pivotable side frame members. (In this and other drawings, phantom lines show the position of pivotable members in an unfolded state.)

10—support frame
12—bed frame
14—power drive unit
16—headboard
18—footboard
20, 22—pivotable side frame members
24—springbox
26, 28—openings of the footboard
30, 32—triangular brackets
34, 36—axles
38, 40—vertical stands
42—pneumatic cylinder
43—piston
44—piston rod
46, 48—links
50—pressure vessel
52—control valve
54—pressure chamber
56—hose
58—seismic sensor
60—wires
62—push button
64—recess
66—outward extension
68—headboard
70—footboard
72, 74—side frame members
76, 78—openings of hollow side frame members
80, 82, 84, 86—vertical stands
88—support frame

90, 92—V-shaped brackets
94, 96—axles
98—horizontal rod
104, 106—axles
108—horizontal rod
110—pneumatic cylinder
112—piston
114—piston rod
116—pressure vessel
118—hose
120—control valve
122—push button
124—recess
125—seismic sensor
126, 128—compartments
130—respiratory mask
132—hose
134—shut-off valve
136—outward extension
138—wall
140—side frame member
142, 144—triangular brackets
146—headboard
150—vertical stand
152—axle
154—power cylinder
156—support base
158—piston rod
160—pressure vessel
162—hose
164—control valve
166, 168—pivotable side frame members
170, 172—triangular brackets
174, 176—loads
178, 180—handles
177, 179—projections
181, 183—recesses
182—frame
186—headboard
188—footboard
190—springbox
192, 194—triangular brackets
193, 195—side frame members
196—stand
198—axle
200—axle
202—stand
203—base
204, 206—slots
208, 210—guide pins
212—toggle-type escapement mechanism
214—stop stand
216, 218—links
220—hinge pivot
222—crossbar
224—cord
F—pulling force
W—weight
228, 230—springs

FIG. 1—DESCRIPTION AND OPERATION—EARTHQUAKE PROTECTIVE BED WITH MECHANICALLY PIVOTABLE SIDE FRAME MEMBERS

An earthquake-protective bed made in accordance with one embodiment of the invention in which the bed has mechanically pivotable side frame members is shown in a schematic perspective view in FIG. 1. In this and other drawings, phantom lines show positions of the pivotable members in an unfolded (protective) state.

The bed has a support frame 10 which supports a bed frame 12 and a power drive unit 14. Frame 12 supports a flat sleep support surface which may be, e.g., a springbox 24 (not shown).

Bed frame 12 consists of a headboard 16, a footboard 18, and pivotable side frame members 20 and 22, which are shown in solid lines in their inactive (rest) position. Headboard 16 and footboard 18 are rigidly interconnected by a conventional rectangular frame (not shown) which supports a spring box 24 of the bed. A mattress, pillows, and a blanket are positioned on top of spring box 24 but not shown as have no relation to the invention and would complicate the drawing.

As can be seen from FIG. 1, footboard 18 is made hollow with openings 26 and 28 on its sides. At the same time, at their ends adjacent footboard 18, side frame members 20 and 22 have triangular rigid brackets 30 and 32 which are parallel to the plane of footboard 18 and are located in its hollow portion. Brackets 30 and 32, and hence side frame members, are pivotally hinged on axles 34 and 36 supported by vertical stands 38 and 40, respectively, which are rigidly attached, e.g., by welding (not shown) to support frame 10.

Side frame members 20 and 22 preferably are formed of steel and sized for a standard double bed 137 cm (54") wide by 188 cm (74") long. Brackets can be made also of steel.

Another pair of triangular brackets (not shown) which are similar to brackets 30 and 32 are also attached to pivotable side frame members 20 and 22 on the side of headboard 16; these brackets are hidden inside the hollow portion of headboard 16.

Drive unit 14 in the illustrated embodiment is shown in the form of a resilient member, e.g. a pneumatic cylinder 42 with a piston 43 which slides inside cylinder 42. Unit 14 is installed vertically on support frame 10. A piston rod 44 of piston 43 protrudes upwardly from cylinder 42 and its upper end is pivotally attached by a link 46 to bracket 30 and by a link 48 to bracket 32.

Drive unit 14 also is located inside the hollow portion of footboard 18 and is hidden from an external view. Installed inside the footboard or in any other suitable place on support frame 10 is a pressure vessel 50 which contains compressed air. Pressure vessel 50 is connected to a conventional control valve 52 by a suitable hose. Valve 52 is connected to a pressure chamber 54 formed above piston 43 by a hose 56 and can be remotely controlled, e.g., by a vibration sensor, such as a seismic sensor 58, in order to admit compressed air from pressure vessel 50 to cylinder 42. Sensor 58 can be attached to the ceiling in the corner of the room where oscillations caused by an earthquake are usually the highest. Valve 52 can be a solenoid valve and sensor 58 can be connected to valve 52 by wires 60. In order to provide an supply of energy which continues to operate when the main power supply is cut off (and this is what normally happens at the moment of an earthquake), the sensor and the valve can be activated from a built-in battery (not shown).

Such a sensor may be comprises of a conventional strain gauge which generates an electric signal when its control element experiences deformaion caused, e.g., by an earthquake. A pushbutton 62 can be interlocked with a battery-fed actuator (not shown) of valve 52 by wires (not shown) in order to cause unfolding of the bed into the earthquake protective state (which is shown by phantom lines in FIG. 1) at the occupant's will without waiting for an automatic command from sensor 58. Button 62 can be hidden in a closable recess 64 in headboard 16 so that the button cannot be pushed unintentionally.

In order to prevent interference of pivotable side frame member 20 with the wall, support frame 10 may have an outward extension 66 of a length sufficient to ensure free rotation of side frame member 20.

With the bed folded, the side frame members 20 are arranged vertically and parallel to each other on both sides of the bed in the positions shown by solid lines in FIG. 1. Piston rod 44 is in its position most extended from cylinder 42, and valve 52 is closed.

When an earthquake occurs, sensor 58 will activate valve 52 and will open the latter so that compressed air will be admitted from pressure vessel 50 via hose 56 into pressure chamber 54 of cylinder 42. Under the effect of pressure, piston 43 will move down and turn, via links 46 and 48, brackets 30 and 32 in opposite directions around their respective axles 34 and 36 until they assume positions shown in FIG. 1 by phantom lines. When opposite edges of frame members 20 and 22 come into contact with each other, they will form a rigid earthquake protective cover or shell above the bed. Thus if debris or the structure of the building falls toward the bed, the cover will absorb the blows from such debris and hold same away from the bed's occupant(s), thereby protecting the occupant(s) from injury. When the earthquake is over, the debris can be removed, and the frame member rotated back to their rest position. In an unfolded state the height of the cover above the mattress may be within the range of 0.5 m to 1 m.

The rotating moment developed by pivotable members 20 is small and need only be sufficient to overcome friction in cylinder 42 and in rotating parts of the mechanism. Therefore, if a bed's occupant, even a child, is sitting on the bed at the moment of activation of the drive mechanism, he/she will not be injured or decapitated as the driving force will be insufficient to crush or injure the occupant. If the unfolding mechanism is activated, e.g., at night when the bed's occupant is sleeping with his/her hand or leg resting on the moveable part, his/her hand or leg will simply be shifted inward as the pivoting members rotate in the upward direction. Moreover, such shifting will wake up the bed's occupant and thus will assist in warning him/her of the danger. Thus, moving parts present no danger of injuring the bed's occupant. The pivoting motion is to be completed within 3 to 5 seconds. The above safety features and operation characteristic relate also to all subsequent embodiments of the invention.

If necessary, the facing edges of side frame members 20 and 22 may have snapping, locking, or latching (not shown) of any suitable design, which will lock members 20 and 22 together in their earthquake-protective position. These elements can be unlatched after the shaking stops so that the frame members can be rotated back. When the frame members are rotated back, brackets 30 and 32 will be turned to the position shown by solid lines in FIG. 1. Rotation of the brackets will switch control valve 52, so that admission of air into chamber 54 will be discontinued and piston 43 will be shifted in the upward direction. In this case, air contained in chamber 54 will be discharged into the atmosphere through a bleeding hole (not shown).

The same sequence of operations occurs when valve 52 is actuated manually from button 62. rather than from sensor 58. The bed's occupant can activate button 62. or in the case of sleeping occupant, aged, infirm, or child occupant, a standing person can activate the button.

Figure 2:
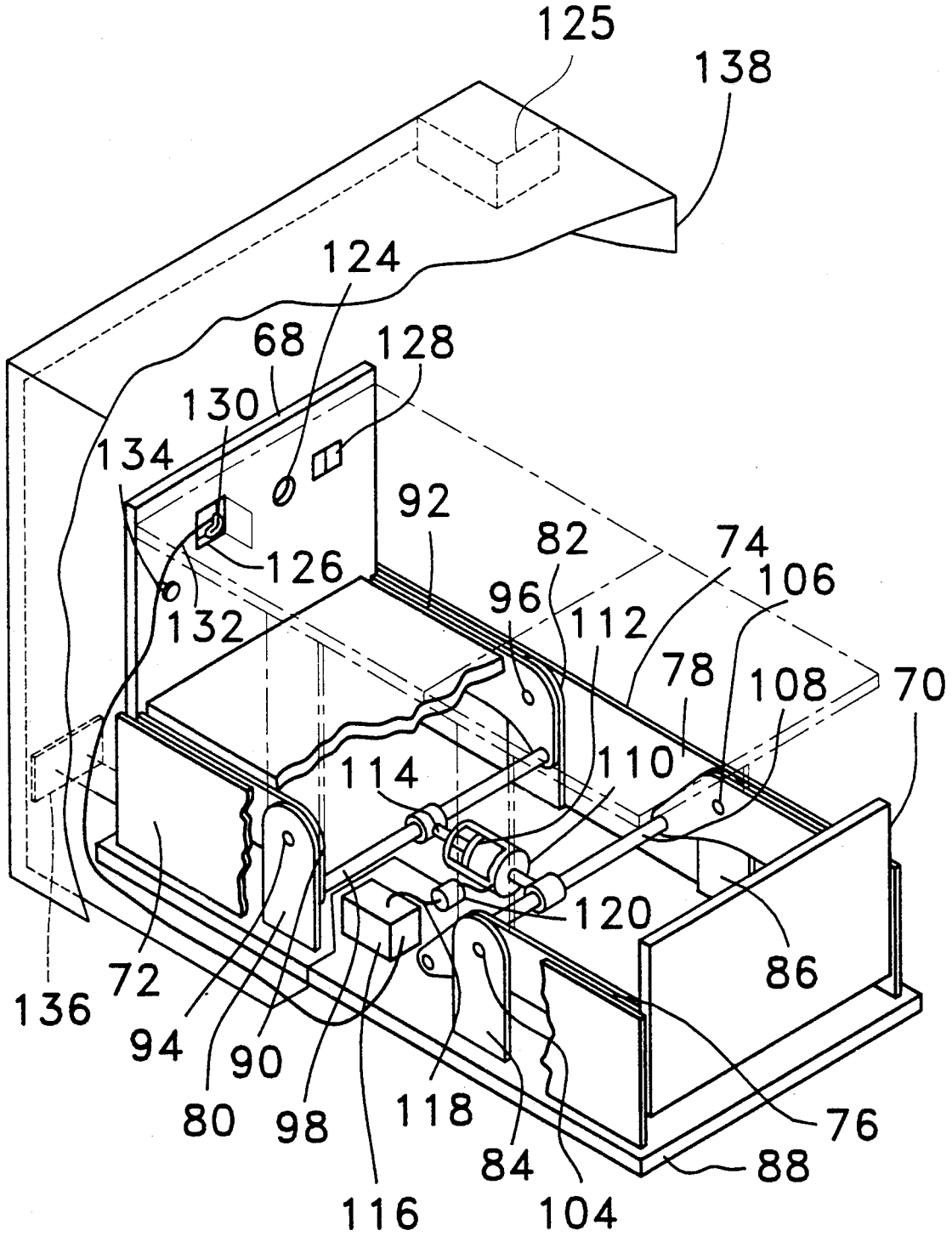
FIG. 2 is a perspective view of such a bed with a mechanically-driven pivotable headboard and footboard.

FIG. 2—DESCRIPTION AND OPERATION—EARTHQUAKE PROTECTIVE BED WITH MECHANICALLY PIVOTABLE HEADBOARD AND FOOTBOARD

Instead of side frame members, the foldable or pivotable parts of the bed may be the bed's footboard and headboard. An embodiment with this construction is shown in FIG. 2. This embodiment is in general similar to that described above with the difference that headboard 68 and a footboard 70 are used to form a protective cover with the bed unfolded.

In the embodiment of FIG. 2, side frame members 72 and 74 are stationary and made hollow with respective openings 76 and 78. Each opening contains a pair of vertical stands 80, 82, and 84, 86, respectively, which are attached to a support frame 88. Stands 80 and 82 pivotally supports V-shaped brackets 90 and 92, respectively, on axles 94 and 96. One end of each bracket is rigidly attached to headboard 68, while its other end is pivotally connected to a horizontal rod 98 arranged perpendicular to side frame members 72 and 74.

In a similar manner, stands 84 and 86 pivotally support V-shaped brackets 100 and 102, respectively, on axles 104 and 106. One end of each bracket is rigidly attached to footboard 70, while its other end is pivotally connected to a horizontal rod 108 arranged perpendicularly to side frame members 72 and 74.

A pneumatic cylinder 110 having a piston 112 with piston rod 114 is supported between rods 98 and 108 so that cylinder 110 is pivotally connected to the central part of rod 108, while piston rod 114 is pivotally connected to the central part of rod 98.

Cylinder 110 is connected to a pressure vessel 116 by a hose 118 via a control valve 120. Valve 120 can be controlled either manually from a pushbutton 122 located in a closable recess 124 of headboard 68, or automatically from a seismic sensor 125 of the same type as sensor 50 of the embodiment of FIG. 1.

With the bed unfolded, headboard 68 and footboard 70 are arranged vertically and parallel to each other on both sides of the bed in the positions shown by solid lines in FIG. 2. Piston rod 44 is in its most withdrawn position in cylinder 110, and valve 52 is closed.

When an earthquake occurs, sensor 125 will activate valve 120 and will open the latter so that compressed air will be admitted from pressure vessel 116 via hose 118 into cylinder 110. Under the effect of pressure, piston 112 will extend from cylinder 110, while the cylinder itself will move in the direction opposite to piston 112. As a result, rods 98 and 108 will spread apart and turn brackets 90, 92 100, and 102 in opposite directions around their respective axles. Since the respective brackets are rigidly connected to headboard 68 and footboard 70, the headboard and the footboard also will turn towards each other until they assume the positions shown in FIG. 2 by phantom lines. When the opposite edges of footboard 68 and headboard 70 come into contact with each other, they will form a rigid earthquake protective cover above the bed.

In all embodiments of the invention, a part of the bed, e.g., the headboard, may incorporate compartments 126, 128, etc. (see FIG. 2) for storing preserved water, food, a flashlight, a battery-powered radio transmitter, or other items which may be required temporarily to sustain an occupant trapped in a disaster area.

One of the compartments, e.g., compartment 126, may contain a respiratory mask 130 which is connected by a hose 132 with a shut-off valve 134 to pressure vessel 116 with compressed air. In case the bed's occupant is trapped under the collapsed building in a closed space with insufficient air for breathing, the occupant can put on mask 130, and use compressed air for breathing by gradually opening shutoff valve 134.

Figure 6:
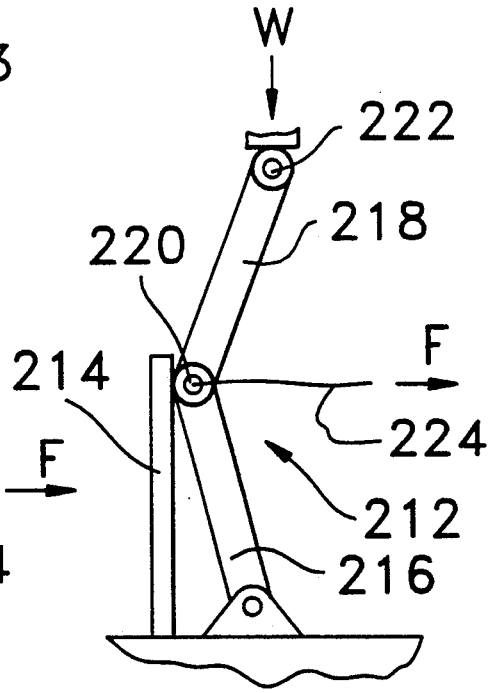
FIG. 6 is a side view of a toggle-type escapement mechanism in an unfolded position of the bed of FIG. 5.

In the embodiment of FIG. 6 with pivotable headboard 68 and footboard 70, support frame 88 may have an outward extension 136 which may be required to provide a space between the bed and wall 138 for turning headboard 68 without interference with wall 138.

Figure 3:
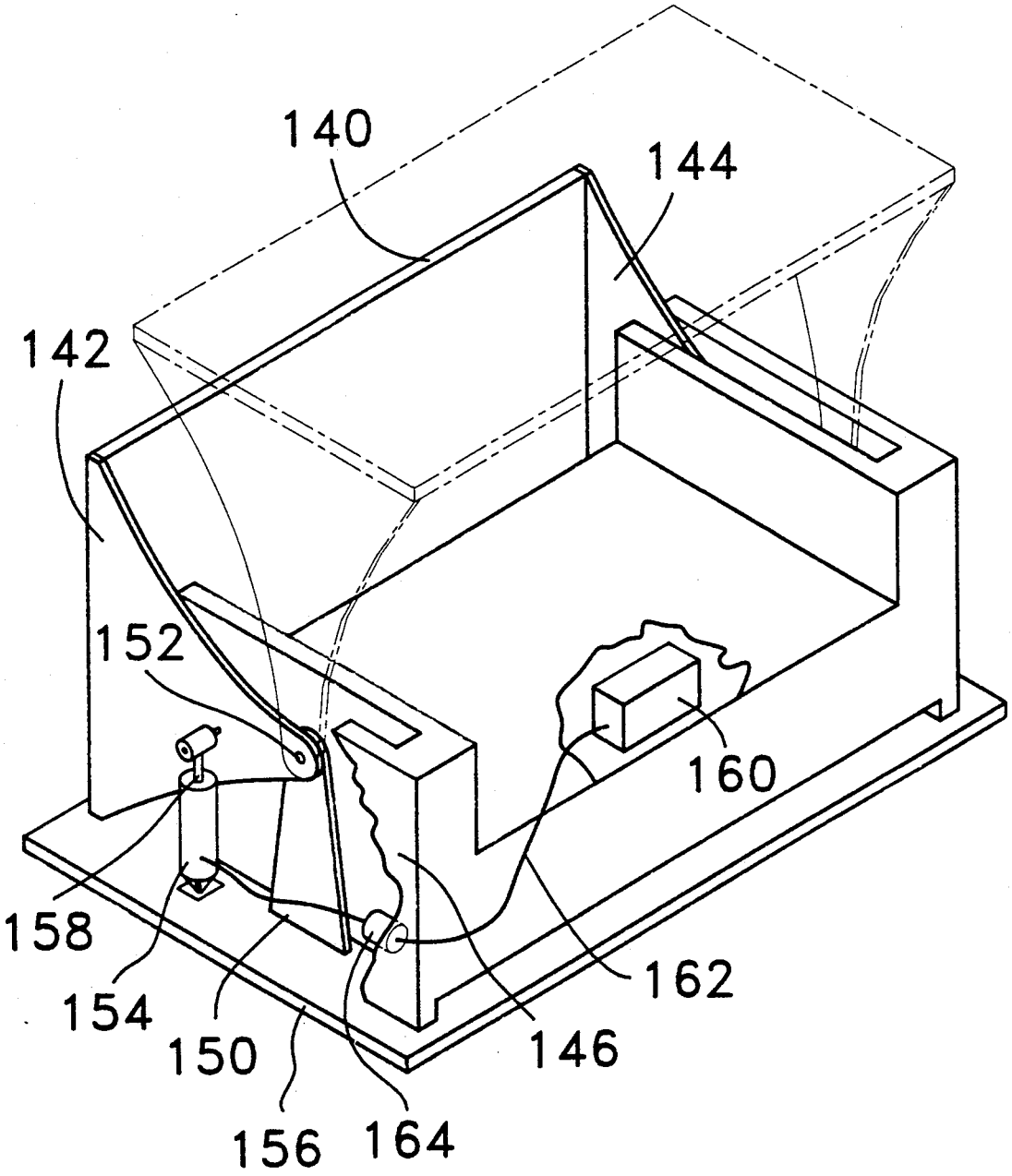
FIG. 3 is a perspective view of such a bed with a single mechanically-driven pivotable member.

FIG. 3—DESCRIPTION AND OPERATION—EARTHQUAKE PROTECTIVE BED WITH ONE MECHANICALLY PIVOTABLE MEMBER

FIG. 3 shows an embodiment of the invention in which an earthquake-protective bed has a single pivotable member capable of forming a protective cover above the bed.

This embodiment in general is similar to that of FIG. 1 with the exception that the bed has only one pivotable side frame member 140 with triangular brackets 142 and 144 rigidly fixed to the opposite sides of side frame member 140. These brackets are hidden in a hollow headboard 146 and footboard 148, respectively.

Similar to the embodiment of FIG. 1, hollow headboard 146 contains a vertical stand 150. Only parts located in headboard 146 will be shown and described. Identical parts are located in the interior of the hollow footboard. A one-sided drive (at the head of the bed) can be used. Stand 150 (and its counterpart in the foot of the bed) pivotally supports brackets 142 and 144 on axles 152.

A power cylinder 154 is pivotally connected to a support base 156, while piston rod 158 of the piston (not shown) sliding in cylinder 154 is pivotally connected to bracket 142.

The device also has a pressure vessel 160 which can be supported by support base 156 and which is connected to cylinder 154 by a hose 162 via a control valve 164.

The bed of the embodiment of FIG. 3 operates in the same manner as beds of previous embodiments. In other words, either under the command of a seismic sensor (not shown) or from a pushbutton (not shown), valve 164 is opened and allows compressed air to flow from pressure vessel 160 to cylinder 154. This causes displacement of the piston in the direction of extension of piston rod 158 from the cylinder 154. As a result, pivotable side frame member 140 will turn in a clockwise direction until it rests upon the upper ends of headboard 146 and footboard 148. In this position side frame member 140 will form a protective cover above the bed.

Figure 4:
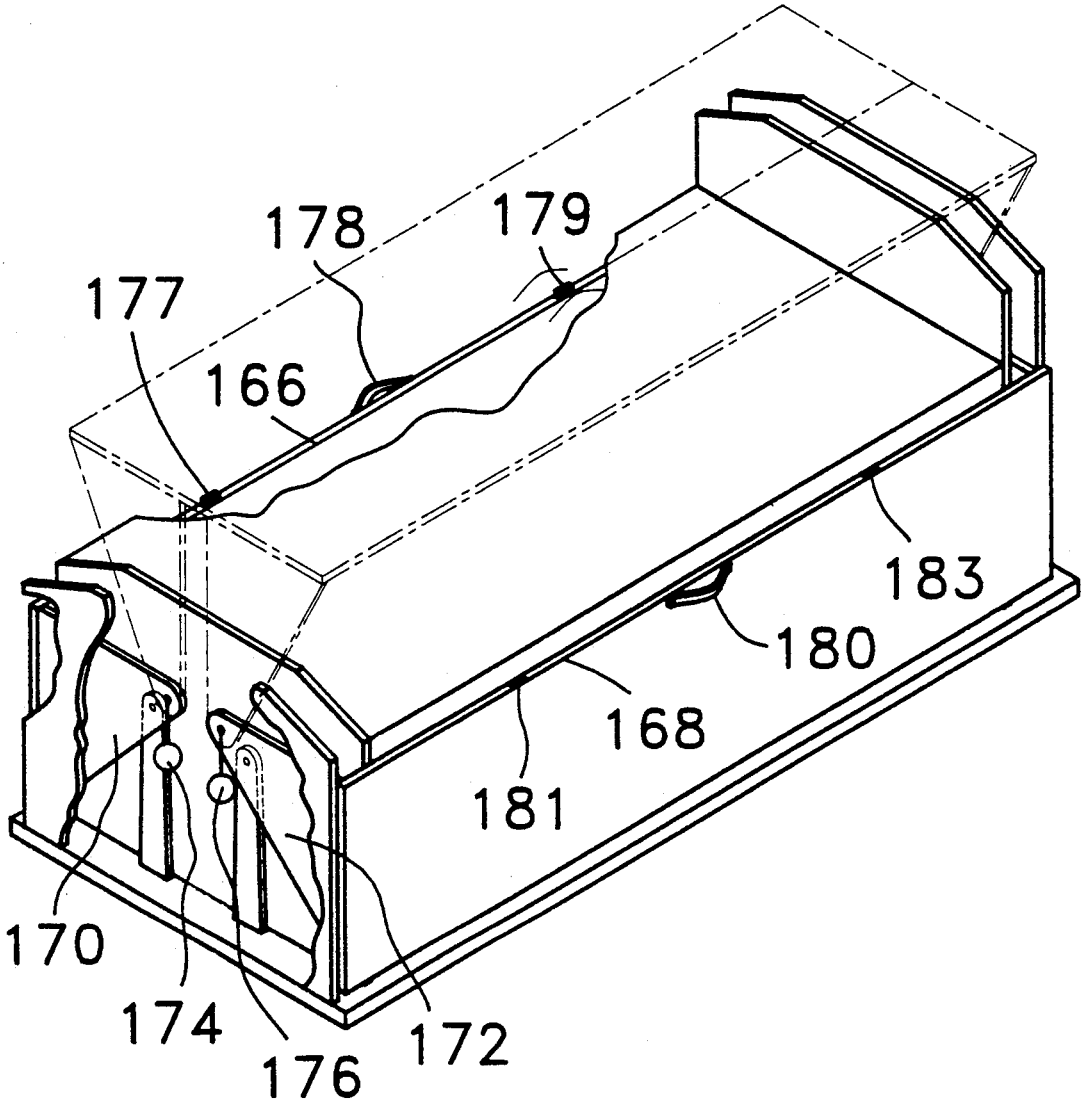
FIG. 4 is a perspective view of such a bed with manually-driven pivotable side frame members.

FIG. 4—DESCRIPTION AND OPERATION—BED WITH MANUALLY-DRIVEN PIVOTABLE SIDE FRAME MEMBERS

FIG. 4 illustrates another embodiment of an earthquake-protective bed of the invention, in which pivotable side frame members 166 and 168 are turned into a protective position (which is shown in FIG. 4 by phantom lines) manually.

As this embodiment is similar to the one shown in FIG. 1, only those parts which are different will be described in detail.

Instead of connections to links 46 and 48 (FIG. 1), the ends of triangular brackets 170 and 172 support respective loads 174 and 176 which are suspended from these ends. The weights of side frame members 166 and 168 are always slightly greater than those created by loads 174 and 176, respectively, so that side frame members 166 and 168 are normally maintained in their unfolded positions, as shown by solid lines in FIG. 4. However, loads 174 and 176 function as counterweights.

Side frame members 166 and 168 have handles 178 and 180.

To unfold the bed into an earthquake-protective position, the occupant pulls handles 178 and 180 up. Only a light force is needed due to the presence of counterweights 174 and 176. Thus side frame members 166 and 168 will be turned towards each other into position shown by phantom lines in FIG. 4.

In order to secure side frame members 166 and 168 in their unfolded position, the bed has snap locks in the form of projections 177 and 179 on side frame member 166 and recesses 181 and 183 on side frame member 168.

To return the bed to its initial state, the cover formed by the side frame members can be opened by unsnapping projections 177 and 179 from recesses 181 and 183 and turning frame members 166 and 168 to their position shown by solid lines in FIG. 4.

Figure 5:
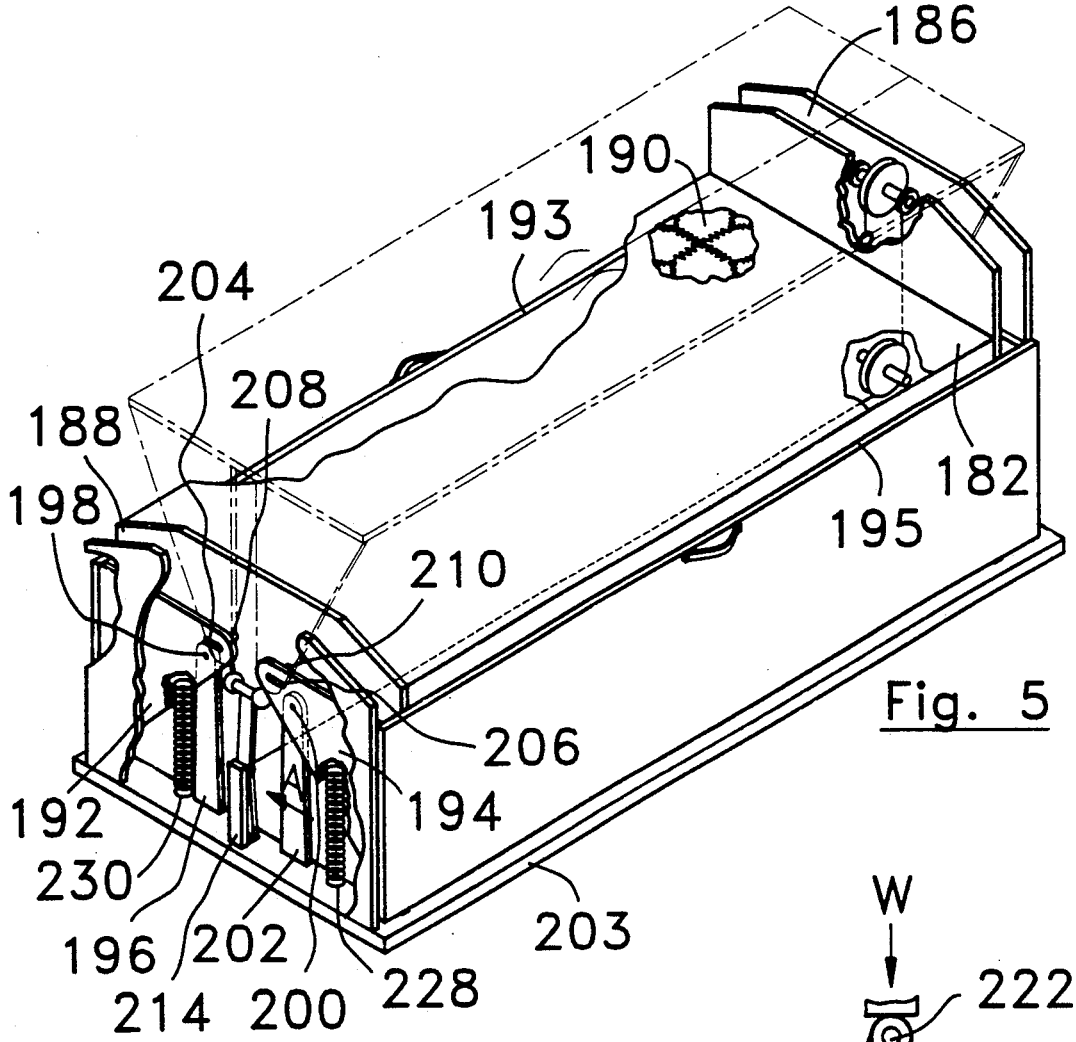
FIG. 5 is a perspective view of such a bed with manually driven pivotable side frame members, the unfolding of which is assisted by the weight of the bed and bed's occupant(s).
Figure 7:
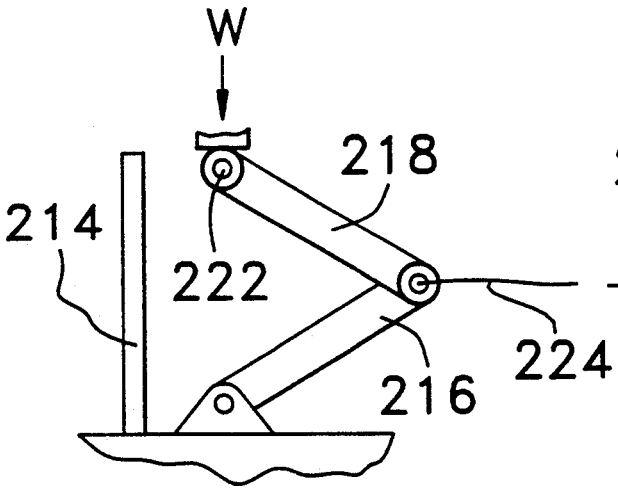
FIG. 7 is a side view of the toggle mechanism of FIG. 6 during unfolding.

FIGS. 5, 6, AND 7—DESCRIPTION AND OPERATION—BED IN WHICH UNFOLDING IS ASSISTED BY THE WEIGHT OF THE BED'S OCCUPANT

FIG. 5 is a perspective view of a bed with manually driven pivotable side frame members, the unfolding of which is assisted by the weight of the bed and its occupant(s).

In this embodiment, a frame 182, which is rigidly connected to a headboard 186 and a footboard 188 and which supports a springbox 190. Springbox 190 in turn supported by two pairs of brackets, i.e., by triangular brackets 192 and 194 on the footboard side and by similar brackets (not shown) on the headboard side. Bracket 192 and the respective invisible brackets are rigidly connected to side frame member 193, while bracket 194 and the respective invisible bracket are rigidly connected to side frame member 195.

Bracket 192 is pivotally supported by a stand 196 on an axle 198, while bracket 194 is pivotally supported on an axle 200 by a stand 202. Stands 196 and 202 are installed on a base 203. Similar arrangements (not shown) exist on the headboard side. The facing ends of brackets 192 and 194 have horizontal slots 204 and 206 which guide pins 208 and 210 rigidly attached to footboard 188. Similar guides and pins (not shown) are provided on the headboard side.

Installed on base 203 between stands 196 and 202 is a toggle-type escapement mechanism 212. This mechanism maintains pivotable side frame members 193 and 195 in a folded state. The mechanism releases the pivotable members at the command of the bed's occupant to unfold into the earthquake-protective position shown in FIG. 5 by phantom lines. The release mechanism operates under the weight of the bed's occupant and the suspended part of the bed.

The mechanism has a stop stand 214 (FIGS. 6 and 7) which is rigidly attached to base 203 and consists of a pair of links 216 and 218 pivotally connected to each other by a hinge pivot 220. A lower end of link 216 is pivotally connected by a hinge pivot 218 to base 203, while upper end of link 218 has a crossbar 222 (FIG. 5) which supports above-mentioned brackets 192 an 194.

FIG. 6 is a side view of a toggle-type escapement mechanism with the bed in an unfolded position. In this position, the hinged ends of links 216 and 218 rest on stop stand 214 which does not allow bed frame 182 to descend under its own weight plus the weight of the bed's occupant. As a result, side frame members 193 and 195 are maintained in their inactive (normal or unfolded) position, as shown by solid lines in FIG. 5.

A flexible cord 224 is connected to hinge pivot 220 and is guided under the bed over appropriate pulleys (not shown) to a handle 226 located, e.g., on headboard 186, so that if necessary, the bed's occupant can easily reach this handle.

In other words, pivotally interconnected links 216, 218, stop stand 214, and pull cord 224 form a toggle mechanism. This mechanism be switched (by pulling cord 224) between a position shown in FIG. 6, in which the bed frame is supported in the unfolded position, and the position of FIG. 7, in which the side frame members 193 and 195 begin to rotate in opposite directions toward each other to form a protective cover (shown by the phantom lines in FIG. 5) above the bed's occupant.

More specifically, when a pulling force (shown by arrow F in FIG. 6) is applied to hinge pivot 220, the mechanism snaps into the position of FIG. 7, which is a side view of the toggle mechanism of FIG. 6 during unfolding. In this position, the interconnected ends of links 216 and 218 are released from stop stand 214, so that the suspended part of the bed, i.e., frame 182, and hence springbox 190 and the bed's occupant, move down under their own weight W (FIG. 7). In order to absorb shocks, springs 228 and 230 can be installed between bed frame 182 and base 203.

SUMMARY, RAMIFICATIONS, SCOPE

Thus, we have shown an earthquake protective bed which has a collapsible construction and which can be converted from a conventional bed into an earthquake-protective bed with a rigid protective cover. The cover's parts are formed of structural elements inherent in a conventional bed, i.e., of footboard and headboard, or of side elements of the bed frame. The bed is converted into an earthquake-protective position either by the bed's occupant or another person, or automatically when the earthquake occurs. In addition, the bed is attractive in appearance, occupies substantially the same space as a conventional bed, and is easy to clean.

Although the invention has been shown and described in the form of the specific embodiments, its parts, materials and configurations have been given only as examples. Many other modifications of this earthquake protective bed invention are possible. For example, drive units other than pneumatic cylinders can be used for moving the pivotable parts. For example, various compression or expansion springs with mechanical release mechanisms instead of a pneumatic valve can be used. At the same time, a vessel with a compressed air can be held in compartments in the bed, along with other survival and/or first aid kit accessories. The drive unit can be provided in the form of a worm and a worm wheel mechanism, or by gear sectors engaged with toothed racks formed on both sides of the piston rod of a pneumatic cylinder, with the sectors being connected to respective brackets of the pivotable members. The drive can be an electric motor with various movement transmission mechanisms. In its simple form the bed can be produced without any drive mechanism at all, but merely with pivotable parts turned into the unfolded position manually with subsequent manual locking. In this case, a bed's occupant can unfold it for a nighttime bed and fold it back in the morning. If necessary, the bed may permanently remain in its folded state. If the owner of the bed moves to a nonseismic area, the bed's cover can be used as a second deck for another occupant, or for storage of various items. The drive unit can be located underneath the bed in its central part, or two symmetrical units can be arranged on both sides of the bed. All drive units shown for the foldable side frame members can drive the foldable headboard and footboard. The bed parts can be made of wood, light aluminum alloy, or any other suitable material. The headboard and the footboard may have curved configurations so that the protective ceiling may have a dome-like shape. The pivotable members may form a triangular roof-like configuration.

Therefore the scope of the invention should be determined, not by the examples given, but by the appended claims and their legal equivalents.

What we claim is:

1. A bed with a foldable earthquake protective cover, comprising:

a support frame for supporting a flat sleep support surface; and at least two moveable members which form a headboard and a footboard of said bed, said headboard and said footboard being pivotally attached to said support frame and capable of being pivoted between a folded position in which said headboard and said footboard are positioned away from said flat sleep support surface and an unfolded position in which they are positioned above said flat sleep support surface, said headboard and said footboard being oppositely arranged and pivotally supported by said support frame so that they can be pivotally turned toward each other from said folded position to cover said sleep support surface.

2. The bed of claim 1, further including drive means for moving said headboard and said footboard into said unfolded position.

3. The bed of claim 2, further including a sensor capable of detecting oscillations caused by an earthquake, explosion, hurricane, or other forces which may lead to building damage, said power drive means being responsive to an output of said sensor.

4. The bed of claim 2 wherein said drive means is a power drive means which comprises:

at least one power cylinder unit installed between said headboard and said footboard, said power cylinder unit having a cylinder and a piston with a piston rod, said cylinder being pivotally hinged to one of said headboard and said footboard, and said piston rod being pivotally hinged to the other of said headboard and said footboard;

a source of compressed gas;

valve means for controlling the supply of said compressed gas from said source to said power cylinder; and control means for activating said valve means for pivoting said headboard and said footboard into said unfolded position.

5. A bed with a foldable earthquake protective cover, comprising:

a support frame for supporting a flat sleep support surface;

at least one moveable member pivotally attached to said support frame and capable of being pivoted between a folded position in which said member is positioned away from said flat sleep support surface and an unfolded position in which said moveable member is positioned above said flat sleep support surface;

drive means for moving said one moveable member into said unfolded position; and a sensor capable of detecting oscillations caused by an earthquake, explosion, hurricane, or other forces which may lead to building damage, said power drive means being responsive to an output of said sensor.

6. The bed of claim 5 wherein said drive means is a power drive means which comprises:

at least one power cylinder unit installed between said one moveable member and said support frame, said power cylinder unit having a cylinder and a piston with a piston rod, said cylinder being pivotally hinged to said moveable member, said piston rod being pivotally hinged to said support frame;

a source of compressed gas;

valve means for controlling the supply of said compressed gas from said source to said power cylinder; and control means for activating said valve means for pivoting said moveable member into said unfolded position.

7. The bed of claim 6 wherein said moveable members are two in number and comprise a pair of oppositely arranged members which are pivotally supported by said support frame so that they can be pivotally turned toward each other from said folded position to cover said sleep support surface.

8. The bed of claim 7 wherein aid bed has a headboard and a footboard and wherein said movable members are said headboard and said footboard.

9. The bed of claim 7 wherein said support frame has side bed frame members and wherein said movable members are said side bed frame members.

10. A bed with a foldable earthquake protective cover, comprising:

a support frame for supporting a flat sleep support surface;

a pair of moveable members pivotally attached to said support frame and capable of being pivoted between a folded position in which said member is positioned away from said flat sleep support surface and an unfolded position in which said moveable member is positioned above said flat sleep support surface;

at least one power cylinder unit installed between said moveable members, said power cylinder unit having a cylinder and a piston with a piston rod, said cylinder being pivotally hinged to one of said moveable members, said piston rod being pivotally hinged to another of said moveable members; a source of compressed gas;

valve means for controlling the supply of said compressed gas from said source to said power cylinder; and control means for activating said valve means for pivoting said moveable members into said unfolded position.

11. The bed of claim 10 wherein at least one element of said bed frame has a plurality of closable compartments with emergency items in case said occupant is trapped in a confined space, at least one of said emergency items being a respiratory mask connected by a flexible hose to said source of compressed gas, said gas being suitable for breathing.

12. The bed of claim 10, further including a sensor connected to said control means.

13. The bed of claim 12 wherein said sensor is located remotely from said bed in an area of a building which is most sensitive to oscillations of said building.

14. A bed with a foldable earthquake protective cover, comprising:

a support frame for supporting a flat sleep support area;

at least two moveable members pivotally attached to said support frame and capable of being pivoted between a folded position in which said members are positioned away from said flat sleep support surface and an unfolded position in which said moveable members is positioned above said flat sleep support surface, said pivotable members having pivotal points and counterweights attached to them on their opposite ends with respect to said pivot points so that said counterweights permanently apply to said pivotable members forces which tend to turn said pivotable members into said unfolded position;

the weights of said pivotable members around said pivotable points being greater than the weights of said counterweights; said pivotable members having handles, so that when an occupant of the bed tries to turn said pivotable members into said unfolded position, said counterweights assist in unfolding; and means for locking said pivotable members in said unfolded position.

15. The bed of claim 14, further including a power drive means for moving said moveable members into said unfolded position.

16. The bed of claim 15 wherein said power drive means comprises at least one power cylinder unit installed between said moveable members and said support frame, said power cylinder unit having a cylinder and a piston with a piston rod, at least one of said cylinder and said piston rod being pivotally hinged to one of said moveable members, said other of said cylinder and said piston rod being pivotally hinged to said other of said moveable members;

a source of compressed gas;

a valve means for controlling the supply of said compressed gas from said source to said power cylinder; and control means for activating said vale means for pivoting said moveable members into said unfolded position.

17. The bed of claim 16, wherein aid moveable members are made in the form of a headboard and a footboard of said bed, respectively.

18. The bed of claim 15 wherein aid power drive means comprises:

at least one power cylinder unit installed between said moveable members and said support frame, said power cylinder nit having a cylinder and a piston with a piston rod, at least one of said cylinder and said piston rod being pivotally connected to said moveable members, said other of said cylinder and said piston rod being pivotally hinged to said support frame;

a source of compressed gas;

valve means for controlling the supply of said compressed gas from said source to said power cylinder; and control means for activating said vale means for pivoting said moveable member into said unfolded position.

19. The bed of claim 18, further including a sensor capable of detecting oscillations caused by an earthquake, explosion, hurricane, or other forces which may lead to building damage, said power drive means being responsive to an output of said sensor.

20. The bed of claim 14, wherein said moveable members are made in the form of a headboard and a footboard, respectively.

21. A bed with a foldable earthquake protective cover, comprising:

a support frame;

a bed frame for supporting a springbox of said bed;

at least two moveable members pivotally attached to said support frame and capable of being pivoted between a folded position in which said members are positioned away from said springbox and an unfolded position in which said moveable members are positioned above said springbox;

a release mechanism which normally supports the weight of said bed frame, including items supported by said bed frame as well as the weight of any bed's occupant and which normally maintains said moveable members in aid folded position; and means for releasing said mechanism to cause said pivotable members to turn into said unfolded position under the effect of said weights.

22. The bed of claim 21 wherein said release mechanism is a toggle mechanism which is switchable between said normal weight supporting position and said position of unfolding under the effect of said weights.

23. The bed of claim 22 wherein said toggle mechanism comprises a stop rigidly connected to said support frame, a first link pivotally connected at one end to said support frame and at its other end to one end of said second link, the other end of said second link being in contact with said pivotal members so that it supports said weights of said bed frame, a pivot of said pivotal connection between said first link and said second link resting onto said stop in said weight supporting position of said toggle mechanism; and said means for releasing said mechanism comprises a cord which is connected to said point of said pivotal connection between said links so that application of a pulling force to said cord will switch said toggle mechanism into a position of releasing said point from said stop so that said weights are released and cause rotation of said pivotable member into said unfolded position.

* * * * *